US006796772B2

(12) United States Patent
Ikeda et al.

(10) Patent No.: US 6,796,772 B2
(45) Date of Patent: Sep. 28, 2004

(54) EJECTOR AND NEGATIVE-PRESSURE SUPPLY APPARATUS USING THE SAME

(75) Inventors: Junichi Ikeda, Tokyo (JP); Atsuya Koshu, Yamanashi (JP); Jun Watanabe, Tokyo (JP)

(73) Assignee: Tokico Ltd., Kawasaki (JP)

( * ) Notice: Subject to any disclaimer, the term of this patent is extended or adjusted under 35 U.S.C. 154(b) by 22 days.

(21) Appl. No.: 10/187,802

(22) Filed: Jul. 3, 2002

(65) Prior Publication Data

US 2003/0007874 A1 Jan. 9, 2003

(30) Foreign Application Priority Data

Jul. 6, 2001 (JP) ..... 2001-206566

(51) Int. Cl.[7] ..... F04F 5/44
(52) U.S. Cl. ..... 417/196; 417/190; 417/198
(58) Field of Search ..... 417/190, 191, 417/196, 198, 174

(56) References Cited

U.S. PATENT DOCUMENTS

RE9,199 E * 5/1880 Coll ..... 417/198
3,754,841 A 8/1973 Grabb et al. ..... 417/189
3,799,195 A * 3/1974 Hermans ..... 137/553
4,566,634 A * 1/1986 Wiegand ..... 239/410
5,374,164 A * 12/1994 Schulz ..... 417/196
6,042,341 A * 3/2000 Richter ..... 417/151

* cited by examiner

*Primary Examiner*—Charles G. Freay
(74) *Attorney, Agent, or Firm*—Wenderoth, Lind & Ponack, L.L.P.

(57) ABSTRACT

An ejector can obtain a sufficiently large suction air quantity without reducing the ultimate vacuum. A diffuser is disposed downstream of a nozzle to form a single Laval nozzle. A suction port is provided between the nozzle and the diffuser. The inlet of the diffuser is enlarged in width so that the side walls thereof extend approximately parallel to each other along the axis of the diffuser over a predetermined length. When air is caused to flow from an inlet closer to the nozzle toward an outlet by the engine intake negative pressure, the flow velocity at a throat portion reaches the sound velocity owing to the effect of the Laval nozzle. Consequently, a high negative pressure is generated at the suction port. The parallel portion formed by enlarging the inlet of the diffuser allows the suction air quantity to be increased without reducing the effect of the Laval nozzle.

21 Claims, 16 Drawing Sheets

EJECTOR AND NEGATIVE-PRESSURE SUPPLY APPARATUS USING THE SAME

BACKGROUND OF THE INVENTION

The present invention relates to an improvement in an ejector for generating a negative pressure and also pertains to an improvement in a negative pressure supply apparatus using an ejector.

In general, an automotive brake system is provided with a pneumatic booster to increase braking force. The pneumatic booster generally uses the engine intake system as a negative pressure source. That is, the engine intake (negative) pressure is introduced into a negative pressure chamber to produce a differential pressure between the intake pressure and the atmospheric pressure, thereby generating thrust in a power piston to assist the brake system with operating physical force.

This type of pneumatic booster suffers from the problem that because it utilizes the engine intake (negative) pressure, the pneumatic booster may be incapable of obtaining a sufficiently high negative pressure (degree of vacuum) under engine running conditions where the engine intake vacuum pressure is low, e.g. immediately after the engine has started cold. In such a case, the servo power may be reduced. The reduction in the servo power becomes a problem in the case of small-sized engines with a small piston displacement (intake air quantity). Under these circumstances, there has heretofore been proposed pneumatic boosters using an ejector to increase the negative pressure to be introduced into the negative pressure chamber [see Japanese Patent Application Unexamined Publication (KOKAI) Nos. Sho 59-50894 and 60-29366].

The ejector has a nozzle and a diffuser disposed downstream of the nozzle. A negative pressure outlet is provided between the nozzle and the diffuser. When a gas is allowed to flow from the nozzle toward the diffuser, a high-speed jet is produced, whereby a high negative pressure can be generated at the negative pressure outlet.

There has recently been an increasing demand for lean-burn and cylinder injection engines to reduce exhaust emissions and increase fuel economy. In these engines, however, the degree of throttling achieved by the throttle valve is low because of the structure thereof, and hence it is difficult to obtain a high intake negative pressure. Therefore, there is an increasing demand for an ejector capable of generating a high negative pressure with a relatively low intake negative pressure.

Regarding a negative pressure supply apparatus for supplying a negative pressure to an automotive brake system, it is required to generate a high negative pressure with a low intake negative pressure and to recover the negative pressure in the negative pressure chamber of the pneumatic booster rapidly after the negative pressure in the negative pressure chamber has been consumed by the operation of the brake system. Accordingly, the ejector is required to be capable of obtaining a high negative pressure (degree of vacuum) with a low intake negative pressure and, at the same time, capable of obtaining a sufficiently large suction air quantity.

SUMMARY OF THE INVENTION

The present invention was made in view of the above-described circumstances.

An object of the present invention is to provide an ejector capable of obtaining a high negative pressure with a low intake negative pressure and, at the same time, capable of obtaining a sufficiently large suction air quantity.

Another object of the present invention is to provide a negative pressure supply apparatus capable of supplying a stable negative pressure by using the ejector.

The present invention is applied to an ejector wherein a diffuser is disposed downstream of a nozzle, and a suction port is disposed between the nozzle and the diffuser. According to the present invention, the nozzle and the diffuser are combined together to form a substantially single Laval nozzle. Moreover, the inlet of the diffuser is enlarged in width so that the side walls thereof extend approximately parallel to each other from the opening of the suction port.

With the above-described structure, the Laval nozzle allows the flow velocity at the throat portion to reach the sound velocity even when the intake negative pressure is low. Thus, a high negative pressure can be obtained. Further, because the inlet of the diffuser is enlarged and extended parallel to the axis of the diffuser, the suction air quantity can be increased without reducing the ultimate vacuum.

In addition, the present invention provides a negative pressure supply apparatus including an air outlet port connected to a negative pressure source. An air inlet port is open to the atmosphere. A negative pressure port is connected to a negative pressure chamber of a negative pressure device. The apparatus further includes a passage for providing communication between the air outlet port and the negative pressure port. A first check valve allows air to flow through the passage only in the direction from the negative pressure port to the air outlet port. An ejector has an air outlet communicating with the air outlet port, an air inlet communicating with the air inlet port, and a negative pressure outlet communicating with the negative pressure port. A second check valve allows air to flow only in the direction from the negative pressure port to the negative pressure outlet. The negative pressure supply apparatus further includes a control valve for selectively opening or closing either the air outlet or the air inlet of the ejector. The control valve operates in response to the negative pressure at the negative pressure port such that the control valve is open until the negative pressure reaches a predetermined negative pressure, and when the negative pressure has reached the predetermined negative pressure, the control valve is closed rapidly.

With the above-described structure, the control valve is open until the negative pressure at the negative pressure port reaches a predetermined negative pressure. The ejector is operated by the negative pressure from the negative pressure source to supply a negative pressure to the negative pressure port from the negative pressure outlet through the second check valve. When the negative pressure at the negative pressure port has reached the predetermined negative pressure, the control valve is closed to stop the operation of the ejector. Consequently, the negative pressure from the negative pressure source is supplied directly to the negative pressure port through the first check valve. Because the control valve is closed rapidly, the function of the ejector will not be degraded during the period of valve-closing transition by restriction of the flow path by the control valve.

In the negative pressure supply apparatus according to the present invention, the control valve may be disposed on the side of the air inlet with respect to the ejector. With this arrangement, the pressure loss caused by the control valve is minimized, and the efficiency of the ejector is increased.

In the negative pressure supply apparatus according to the present invention, the control valve may be arranged so that the end of its valving member facing the direction in which the control valve moves when it is closed is subjected to a pressure which is lower than that at the other end.

The above and other objects, features and advantages of the present invention will become more apparent from the following description of the preferred embodiments thereof, taken in conjunction with the accompanying drawings.

BRIEF DESCRIPTION OF THE DRAWINGS

FIG. 7(*b*) is a diagram schematically showing the ejector in FIG. 2, in which a parallel portion is provided at the inlet of the diffuser.

FIG. 7(*c*) is a diagram showing static pressure distributions in the ejectors shown in FIGS. 7(*a*) and 7(*b*).

DETAILED DESCRIPTION OF THE INVENTION

Embodiments of the present invention will be described below with reference to the accompanying drawings.

Figure 1:
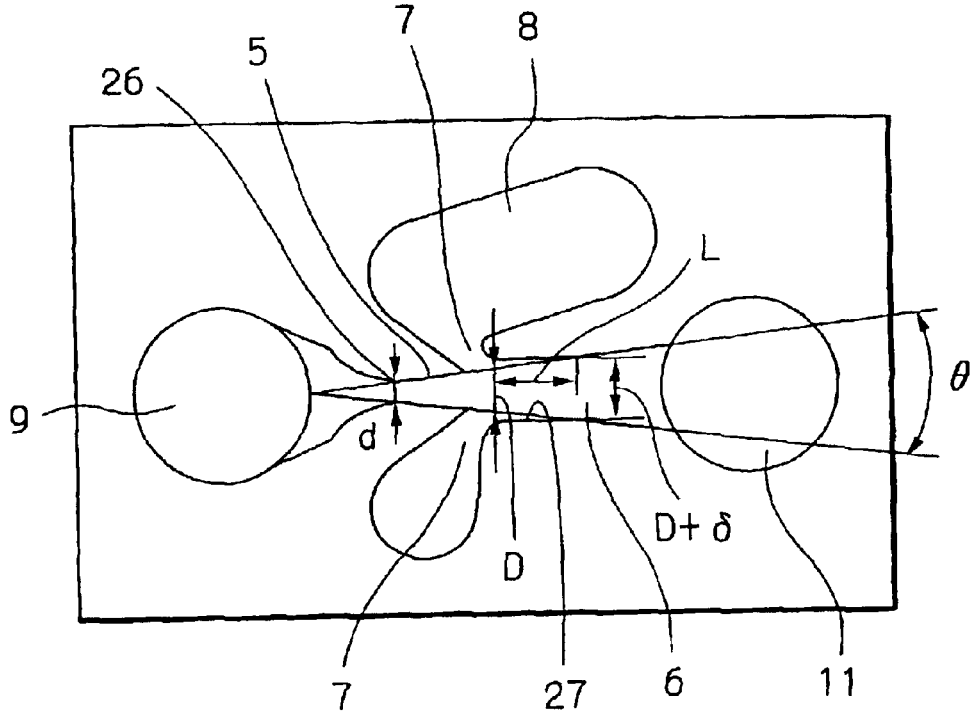
FIG. 1 is a plan view of an ejector body in a first embodiment of the ejector according to the present invention.
Figure 2:
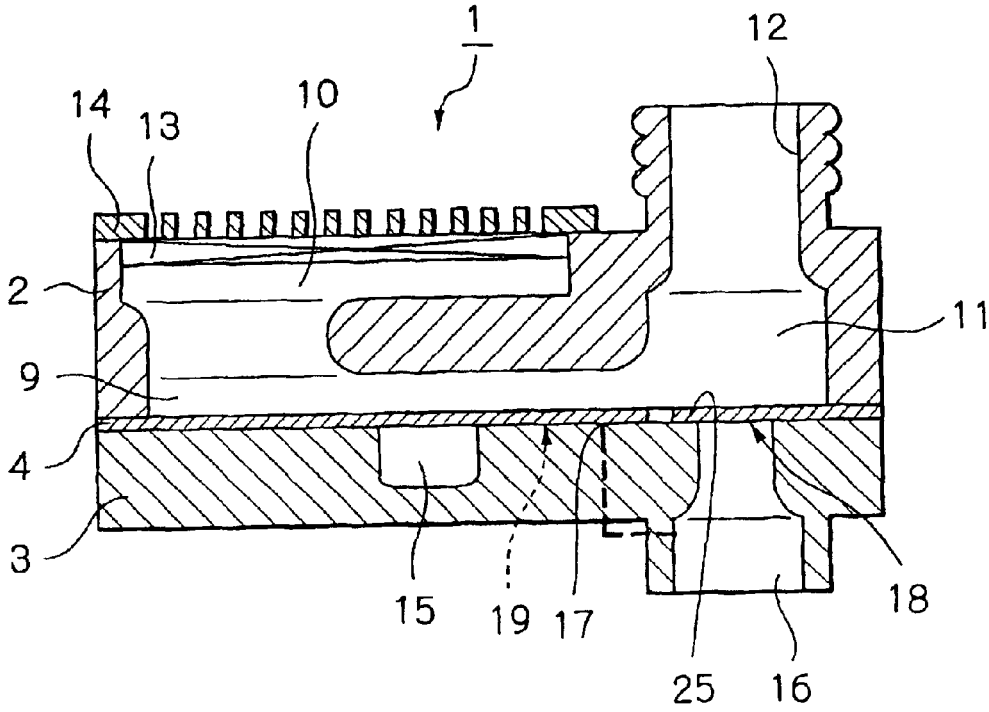
FIG. 2 is a vertical sectional view of the first embodiment of the ejector according to the present invention.
Figure 3:
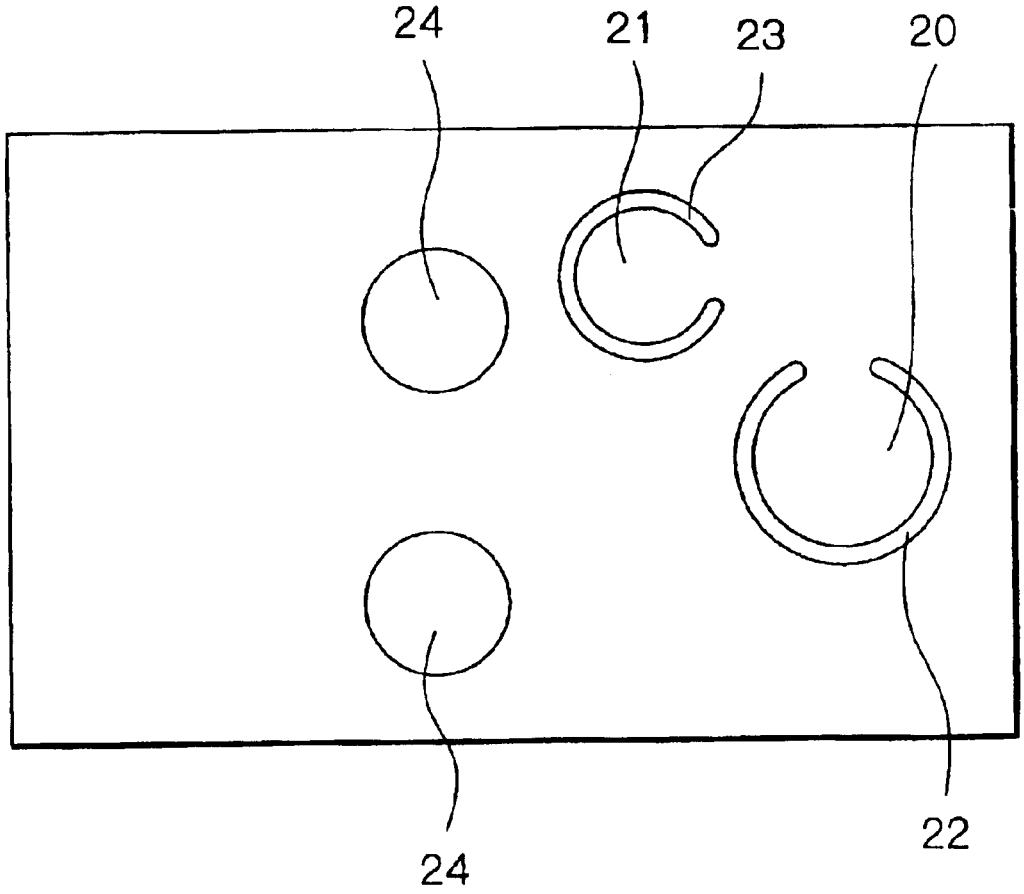
FIG. 3 is a plan view of a seal plate of the ejector shown in FIG. 2.

A first embodiment of the ejector according to the present invention will be described with reference to FIGS. 1 to 3. As shown in FIGS. 1 and 2, an ejector 1 comprises an ejector body 2 and a back plate 3, which are joined together as one unit with a seal plate 4 interposed therebetween.

The ejector body 2 has a flat recess formed in a flat joint surface thereof at which it is connected to the back plate 3. The flat recess forms a nozzle 5, a diffuser 6, a pair of suction ports 7 disposed therebetween, and a negative pressure passage 8 communicating with one suction port 7. The rear side of the ejector body 2 is formed with a filter chamber 10 communicating with an inlet 9 of the nozzle 5 and further formed with an intake pipe connecting port 12 communicating with an outlet 11 of the diffuser 6. The ejector body 2 including these elements can be integrally molded easily by a molding process, e.g. injection molding of a synthetic resin material, die casting, or metal injection molding (MIM). A filter element 13 is installed in the opening of the filter chamber 10 and secured with a porous plate 14.

The back plate 3 has a recess formed in a joint surface thereof at which it is connected to the ejector body 2. The recess forms a communicating passage 15 for providing communication between the pair of suction ports 7. Further, the back plate 3 is formed with a booster connecting port 16 communicating with the intake pipe connecting port 12. The back plate 3 is further formed with a negative pressure outlet 17 communicating with the negative pressure passage 8 to provide communication between the negative pressure passage 8 and the booster connecting port 16. The back plate 3 including these elements can be integrally molded easily by a molding process, e.g. injection molding of a synthetic resin material, die casting, or metal injection molding (MIM).

The seal plate 4 is formed from a thin plate-shaped spring member having a thin rubber or non-rigid resin coating stuck fast to each side thereof. As shown in FIG. 3, the seal plate 4 is punched with arcuate grooves 22 and 23 for forming disk-shaped valving elements 20 and 21 of check valves 18 and 19 disposed in the booster connecting port 16 and the negative pressure outlet 17, respectively. Further, the seal plate 4 is punched with a pair of holes 24 for providing communication between the suction ports 7 and the communicating passage 15. The check valve 18 rests the valving element 20 on a valve seat 25 formed on the back plate 3 to allow air to flow only in the direction from the booster connecting port 16 to the intake pipe connecting port 12. The check valve 19 rests the valving element 21 on a valve seat (not shown) formed on the back plate 3 to allow air to flow only in the direction from the negative pressure outlet 17 to the negative pressure passage 8.

Next, the nozzle 5 and the diffuser 6 of the ejector 1 will be described with regard to the configurations thereof.

As shown in FIG. 1, the nozzle 5 and the diffuser 6 are disposed in connection with each other so as to form a single Laval nozzle having a smoothly converging inlet and a diverging outlet with a small divergence angle. The term "Laval nozzle" as used herein means a pipe or wall means having a flow path that gradually narrows from an inlet thereof as far as the narrowest portion (throat) and gently expands therefrom, or a flow path defined by such wall means. In a two-dimensional nozzle with a rectangular cross-section as shown in the figure, the divergence angle θ of the diverging portion is set at 5 to 10 degrees. In the case of a coaxial three-dimensional nozzle having a circular cross-section or the like, the divergence angle θ should be reduced to about 3 to 6 degrees in consideration of the rate of change of cross-sectional area. The converging inlet has a shape formed by smoothly curved lines (or circular arcs) to minimize loss. The throat portion 26, which is the narrowest portion of the nozzle 5, has a shape formed by curved lines so as to smoothly connect together the converging inlet and the diverging outlet. In order to obtain a high suction negative pressure with a working negative pressure of about −200 mmHg, the openings of the suction ports 7 are disposed downstream of the throat portion 26 by a distance about 2 to 3 times the throat width (diameter).

In the illustrated example, the diverging outlet of the Laval nozzle has a shape formed by straight lines (and hence the angle θ is determined). However, the diverging outlet should preferably have a shape formed by gently curved lines to avoid a sudden change in the rate of change of cross-section in a case where the downstream side of the Laval nozzle is connected to a straight pipe with a rectangular cross-section like a wind tunnel and a substantially uniform flow velocity is required over the entire cross-section.

The diffuser 6 has an inlet 27 downstream of the openings of the suction ports 7. The inlet 27 has an enlarged width D+δ, and the side walls thereof extend approximately parallel to each other along the axis of the diffuser 6 over a length L. In this case, it is effective if the enlarged width D+δ and the length L are set to satisfy the condition of $D+\delta<L$. Here, D is the distance at the diffuser inlet end between lines that define the angle θ determined by the linear divergence of the nozzle 5. In the case of a coaxial three-dimensional nozzle with a circular cross-section or the like, the inlet 27 should preferably have a straight-pipe shape obtained by axially extending the shape of the diffuser inlet portion at the suction port openings.

The operation of this embodiment, arranged as stated above, will be described below.

Figure 4:
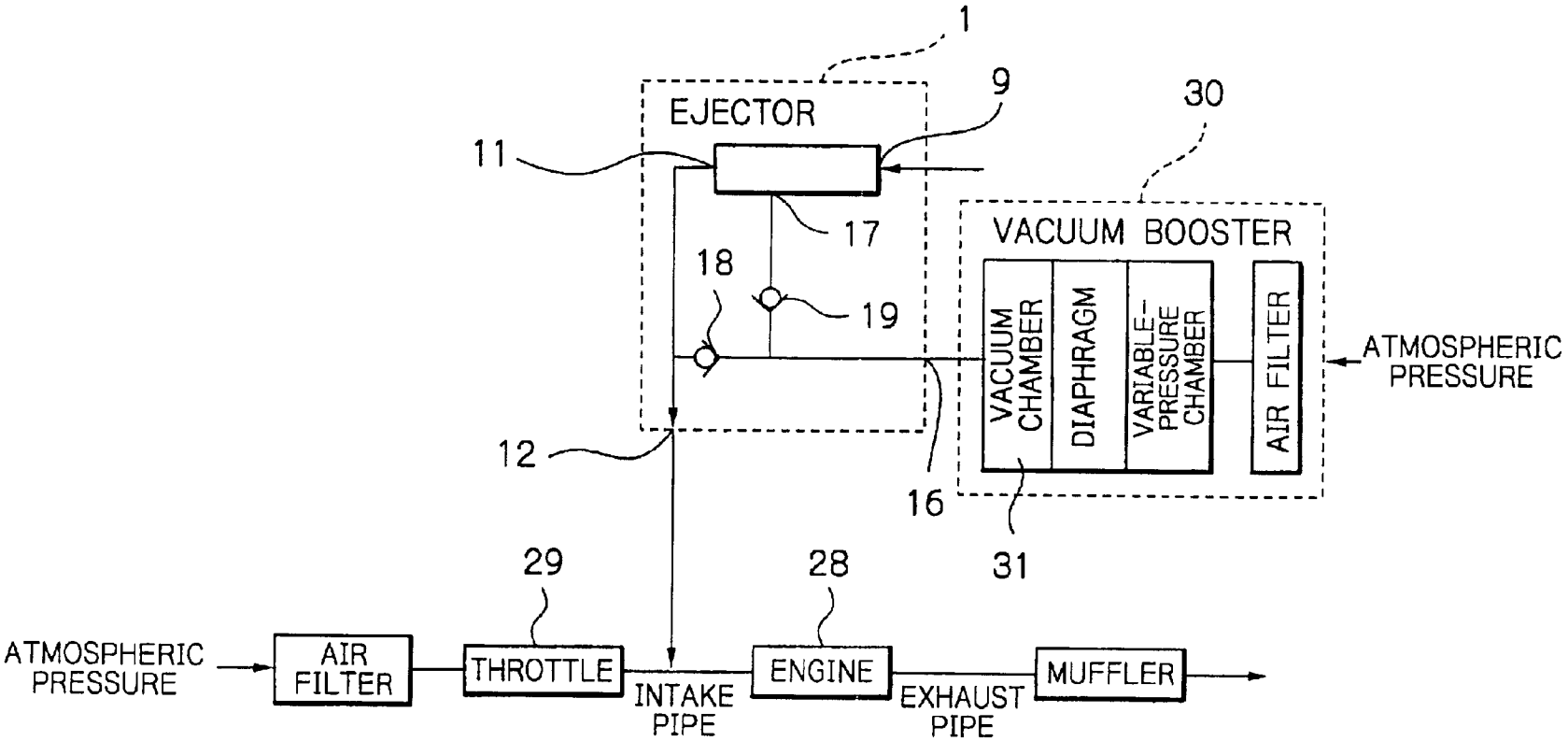
FIG. 4 is a block diagram schematically showing the arrangement of a pneumatic booster using the ejector shown in FIG. 2 as a negative pressure supply apparatus.

As shown in FIG. 4, the ejector 1 is connected at the intake pipe connecting port 12 to the downstream side of a throttle valve 29 in an intake pipe of an engine 28. The booster connecting port 16 of the ejector 1 is connected to a negative pressure chamber 31 (vacuum chamber) of a pneumatic booster 30 (vacuum booster). Thus, the ejector 1 is used as a negative pressure supply apparatus.

When the intake negative pressure of the engine 28 is sufficiently higher than the negative pressure in the negative pressure chamber 31, the intake negative pressure is introduced directly into the negative pressure chamber 31 through the check valve 18. When the engine intake negative pressure is not sufficiently high with respect to the negative pressure in the negative pressure chamber 31, air is introduced from the inlet 9 of the ejector 1 by the intake negative pressure. The introduced air flows toward the outlet 11. The flow of the air generates a high negative pressure at the suction ports 7. This negative pressure is introduced into the negative pressure chamber 31 through the check valve 19. Thus, even when the intake negative pressure of the engine 28 is low, a high negative pressure can be generated by the ejector 1 and introduced into the negative pressure chamber 31.

The structure in which the ejector body 2 and the back plate 3 are joined together through the seal plate 4 allows the ejector body 2 and the back plate 3 to be readily produced with high accuracy by a molding process, e.g. injection molding of a resin material, die casting, or metal injection molding (MIM). The filter element 13 and the check valves 18 and 19 can be integrally incorporated into the ejector 1. Therefore, it is possible to reduce the overall size of the ejector 1. The use of the seal plate 4, which is formed from a thin plate-shaped spring member having a thin rubber or non-rigid resin coating stuck fast to each side thereof, makes it possible to surely seal the joint between the ejector body 2 and the back plate 3.

Although in the foregoing embodiment the filter element is accommodated in the ejector, the arrangement may be such that the filter element is omitted, and the inlet side of the ejector is connected to an air filter of the engine intake system.

The ejector 1 has the nozzle 5 and the diffuser 6 combined together to form a single Laval nozzle having a smoothly converging inlet and a diverging outlet with a small divergence angle. Therefore, the flow velocity at the throat portion 26 reaches the velocity of sound at a low working pressure. A supersonic flow of Mach 1.2 to 1.5 can be obtained at the center axis near the suction ports 7. Accordingly, a sufficiently high negative pressure can be generated at the suction ports 7.

Further, the inlet 27 of the diffuser 6 is enlarged and extended approximately parallel to the axis of the diffuser 6, whereby even when the negative pressures at the outlet 11 and the suction ports 7 are approximately equal to each other at the early stages of the operation, the total air quantity of the amount of working air from the inlet 9 and the amount of air sucked from the suction ports 7 is not limited at the inlet 27 of the diffuser 6. Therefore, a sufficiently large suction air quantity can be ensured. Thus, the negative pressure in the negative pressure chamber 31 consumed by the operation of the brake system can be recovered rapidly. Further, because the diverging portion of the diffuser 6 is positioned so that the lines extended from the walls of the outlet diverging portion of the nozzle 5 coincide with the walls of the diverging portion of the diffuser, a single Laval nozzle in effect can be formed, and there is no separation of the boundary layer at the side wall of the diffuser 6. Therefore, there is no reduction of the negative pressure at the suction ports 7. Thus, a high degree of vacuum can be attained. Accordingly, it is possible to supply a sufficiently high negative pressure to the negative pressure chamber 31 even when the intake negative pressure is low.

Figure 7A:
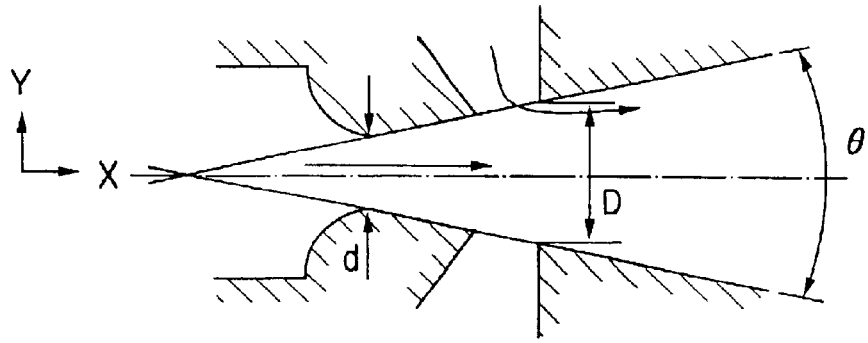
FIG. 7(*a*) is a diagram schematically showing the arrangement of an ejector in which no parallel portion is provided at the inlet of a diffuser.
Figure 7B:
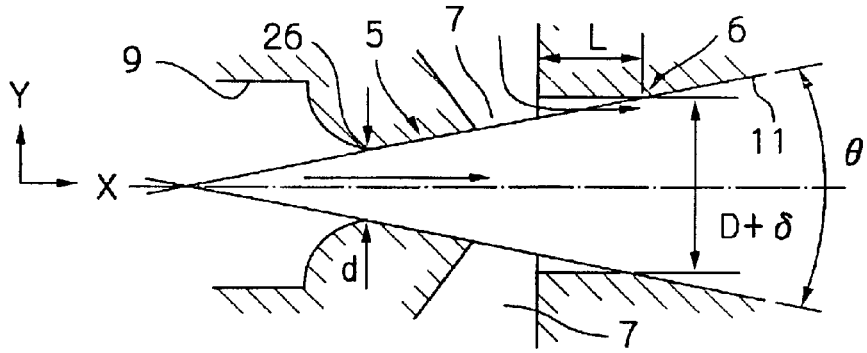
Figure 7C:
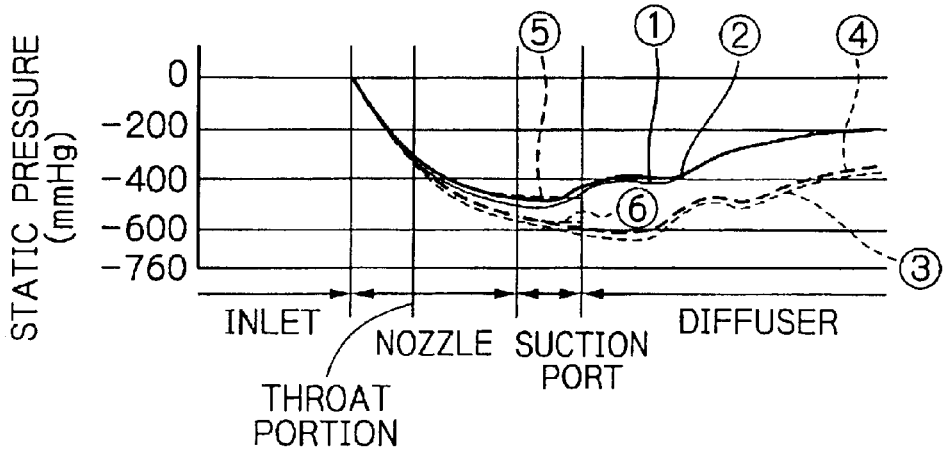

FIG. 7(*a*) shows the arrangement of an ejector in which no parallel portion is provided at the inlet of the diffuser 6. FIG. 7(*b*) shows the arrangement of an ejector (present invention) in which a parallel portion is provided at the inlet of the diffuser 6. FIG. 7(*c*) shows the static pressure distributions in the axial direction (x direction) in the ejectors shown in FIGS. 7(*a*) and 7(*b*). In FIG. 7(*c*), the thin solid line ① and the thick solid line ② respectively show the static pressure distributions in the x direction when the negative pressure at the outlet 11 is −200 mmHg in the ejector provided with no parallel portion, shown in FIG. 7(*a*), and in the ejector provided with a parallel portion, shown in FIG. 7(*b*). The thin broken line ③ and the thick broken line ④ respectively show the static pressure distributions in the x direction when the negative pressure at the outlet 11 is −300 mmHg in the ejector provided with no parallel portion, shown in FIG. 7(*a*), and in the ejector provided with a parallel portion, shown in FIG. 7(*b*). It should be noted that the static pressure distributions (not shown) in a direction (y direction) perpendicular to the axis are approximately uniform. It will be understood from FIG. 7(*c*) that there is almost no difference in the ultimate vacuum to be attained between the ejectors shown in FIGS. 7(*a*) and 7(*b*), and a sufficiently high negative pressure can be obtained regardless of whether or not a parallel portion is provided at the inlet of the diffuser 6. The dotted lines ⑤ and ⑥ in FIG. 7(*c*) respectively show average values of negative pressures at the suction ports 7 when the outlet negative pressure is −200 mmHg and −300 mmHg in the ejector provided with a parallel portion as shown in FIG. 7(*b*).

Figure 8:
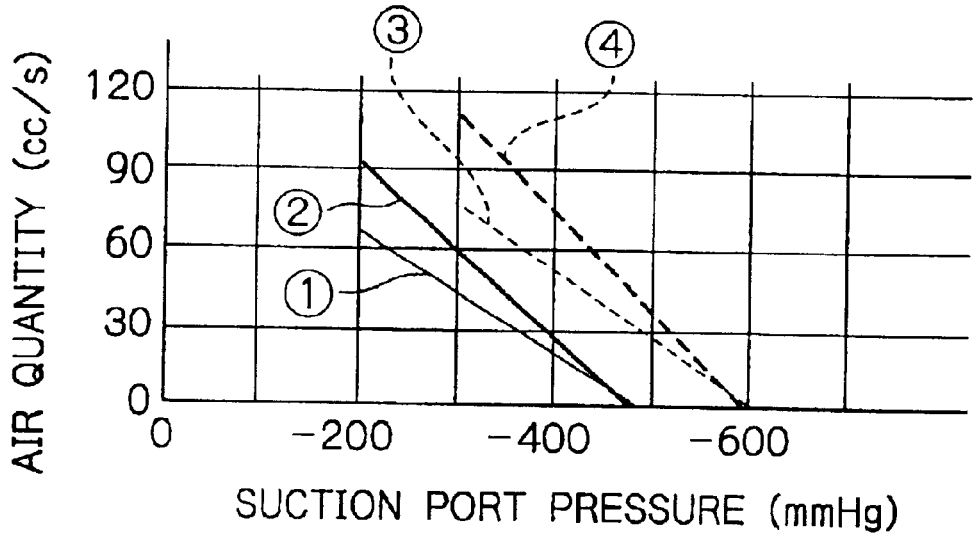
FIG. 8 is a diagram showing the relationship between the suction port pressure and the air quantity in the ejector shown in FIG. 2.

FIG. 8 shows the suction air quantity (expressed in terms of the condition under the atmospheric pressure) with respect to the negative pressure at the suction ports 7. In FIG. 8, the thin solid line ① and the thick solid line ② respectively show the suction air quantities when the negative pressure at the outlet 11 is −200 mmHg in the ejector provided with no parallel portion, shown in FIG. 7(*a*), and in the ejector provided with a parallel portion, shown in FIG. 7(*b*). The thin broken line ③ and the thick broken line ④ respectively show the suction air quantities when the negative pressure at the outlet 11 is −300 mmHg in the ejector provided with no parallel portion, shown in FIG. 7(*a*), and in the ejector provided with a parallel portion, shown in FIG. 7(*b*). It will be understood from the above that the suction air quantity can be increased without reducing the ultimate vacuum. In the ejector provided with a parallel portion in regard to FIGS. 7 and 8, the length L of the parallel portion is set at L=1 mm with respect to the enlarged width $D+\delta=0.894$ mm at the inlet of the suction ports 7 to satisfy the condition of $D+\delta<L$, thereby effectively increasing the suction air quantity.

Figure 5:
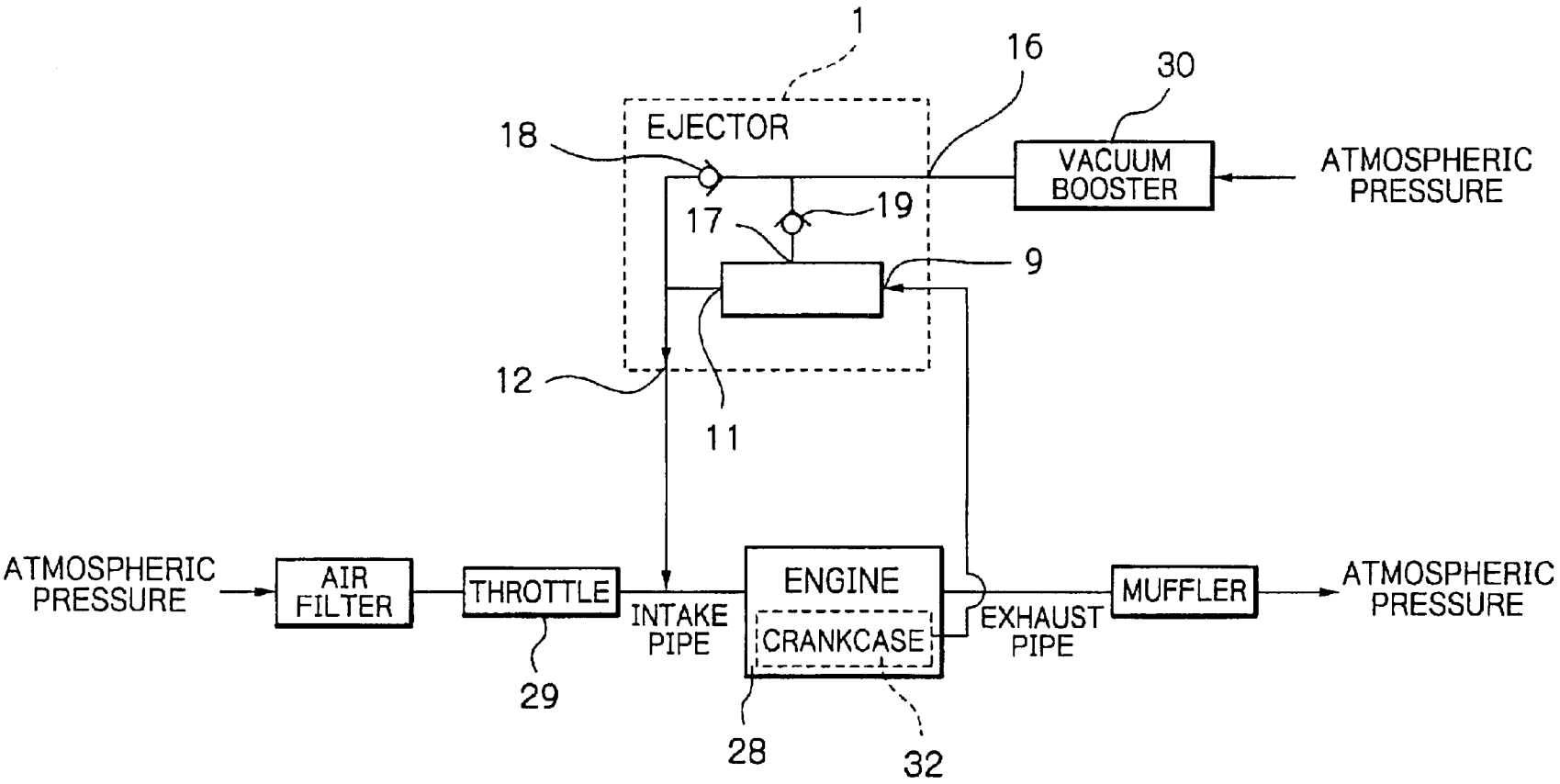
FIG. 5 is a block diagram schematically showing the arrangement of another pneumatic booster using the ejector shown in FIG. 2 as a negative pressure supply apparatus.

Next, other use examples of the ejector 1 will be described with reference to FIGS. 5 and 6. The ejector 1 may be connected as shown in FIG. 5. That is, the intake pipe connecting port 12 is connected to the downstream of the throttle valve 29 in the intake pipe of the engine 28. The booster connecting port 16 is connected to the negative pressure chamber (vacuum chamber) of the pneumatic booster 30 (vacuum booster). The inlet 9 is connected to a crankcase 32 of the engine 28. In this case, blow-bye (combustion gas) from the engine 28 is allowed to flow from the inlet 9 to the outlet 11 as a working gas for the ejector 1, thereby generating a negative pressure at the suction ports 7. At the same time, the blow-bye can be returned to the intake pipe. Thus, the blow-bye can be prevented from being released into the atmosphere.

Figure 6:
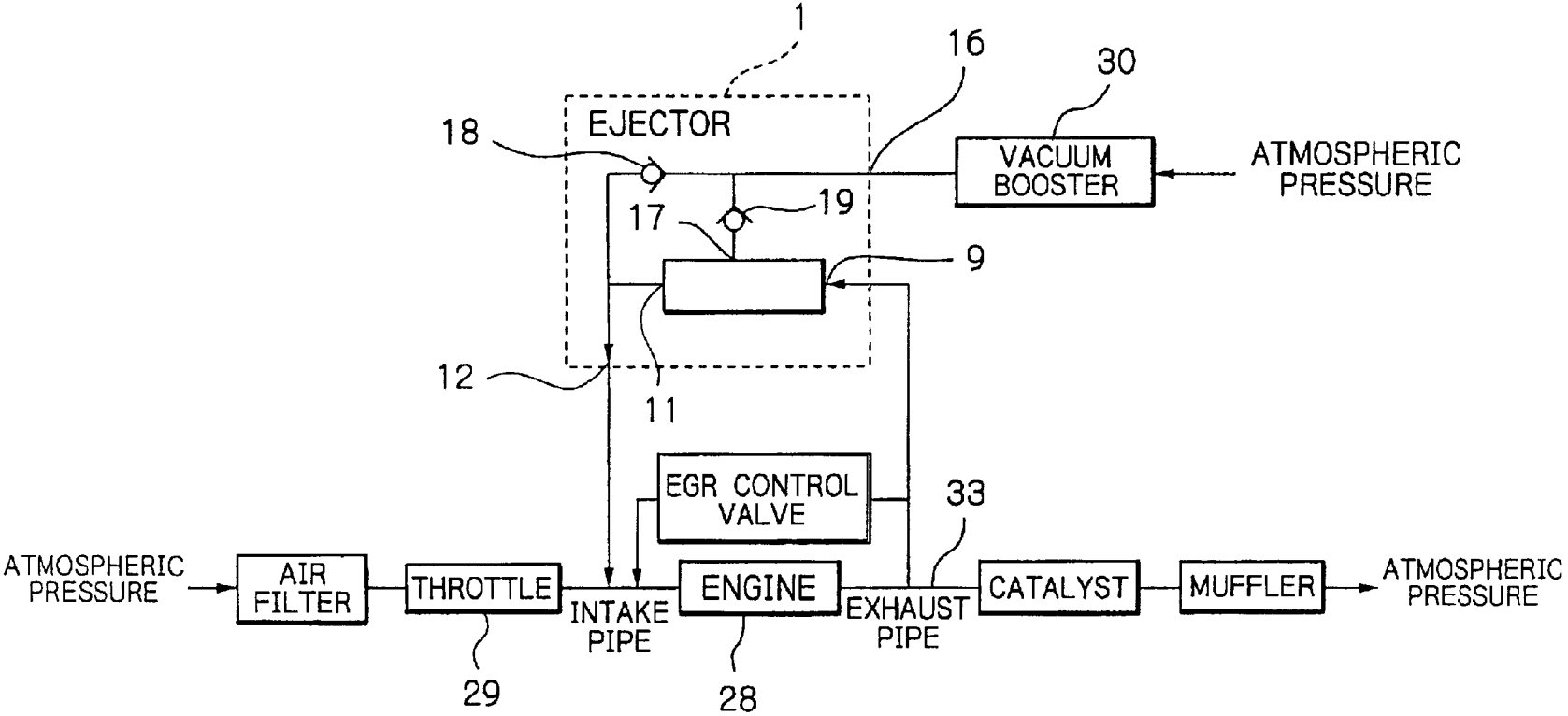
FIG. 6 is a block diagram schematically showing the arrangement of still another pneumatic booster using the ejector shown in FIG. 2 as a negative pressure supply apparatus.

As shown in FIG. 6, the inlet 9 of the ejector 1 may be connected to an exhaust pipe 33 so that a part of exhaust gas from the engine 20 flows back to the intake pipe through the ejector 1. In this case, a positive pressure of the exhaust gas acts on the inlet 9 of the ejector 1. Therefore, the flow velocity of the working gas is increased, and thus a high negative pressure can be generated. In addition, because a positive pressure acts on the inlet 9, a negative pressure can be obtained even if the outlet 11 is open to the atmosphere.

It is also possible to combine together a plurality of ejectors 1 arranged as shown in FIGS. 4 to 6. In this case, the suction ports of the ejectors 1 are connected to the negative pressure chamber of the pneumatic booster through respective check valves, whereby the highest negative pressure of those generated in the ejectors 1 can be introduced into the negative pressure chamber. Thus, it is possible to minimize the effect of the reduction of the intake negative pressure due to operating conditions.

Figure 9:
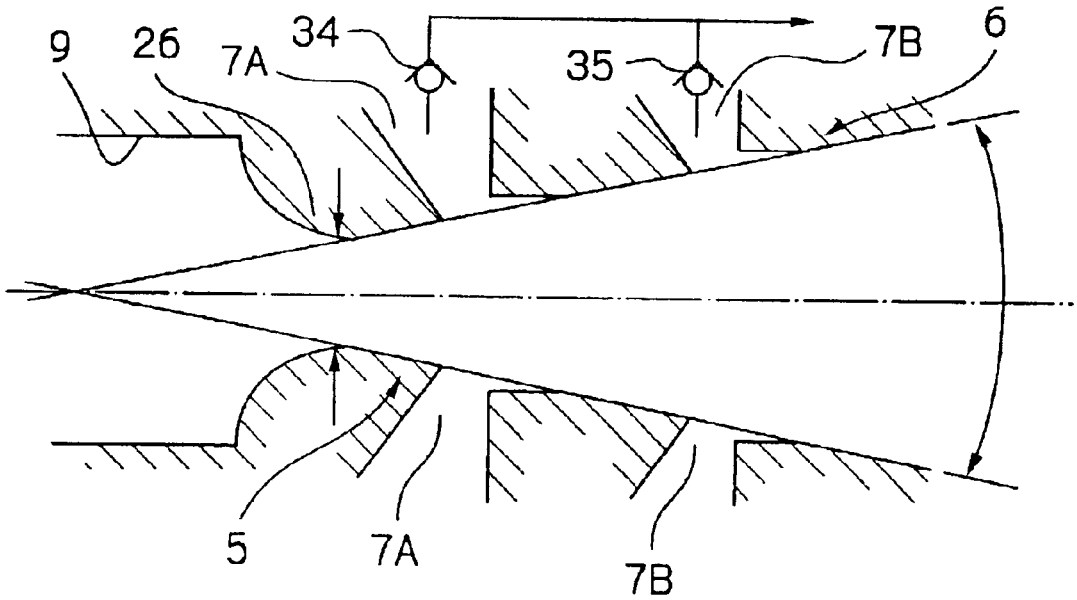
FIG. 9 is a diagram schematically showing the arrangement of a second embodiment of the ejector according to the present invention.
Figure 10:
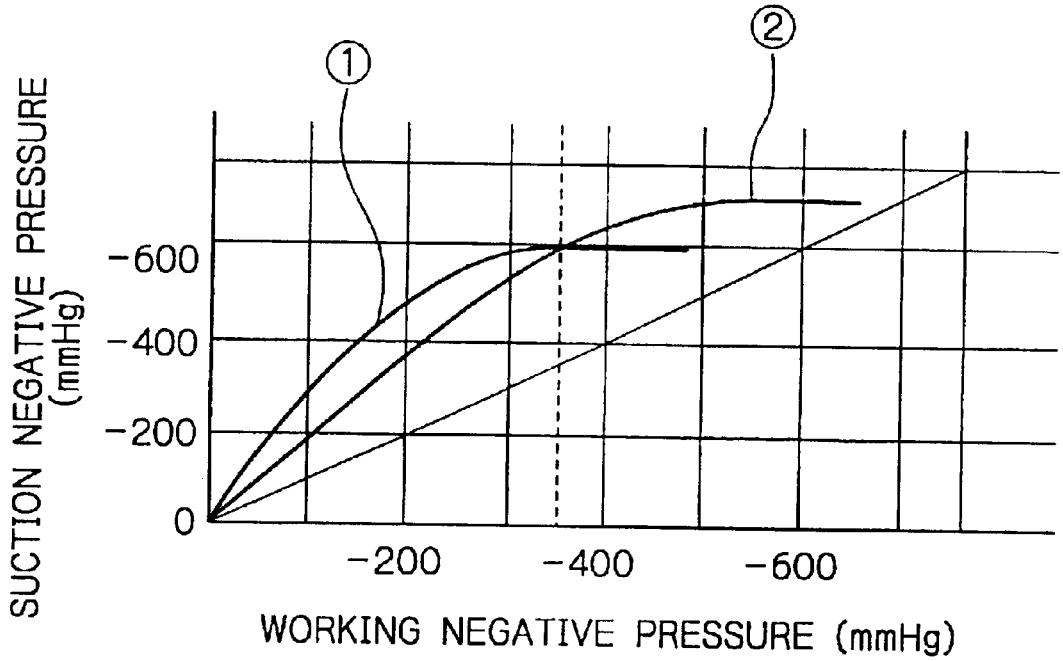
FIG. 10 is a diagram showing the relationship between the working negative pressure and the suction negative pressure in the ejector shown in FIG. 9.

A second embodiment of the ejector according to the present invention is shown in FIG. 9. As shown in the figure, a plurality of pairs of suction ports 7A and 7B are disposed along the axial direction of the nozzle 5 and the diffuser 6, and check valves 34 and 35 are provided for the suction ports 7A and 7B, whereby it is possible to selectively supply the highest negative pressure of those generated from the suction ports 7A and 7B in accordance with the working negative pressure. Thus, a high negative pressure can be obtained over a wide working negative pressure range. For example, the suction ports 7A are optimized for a working negative pressure of −200 mmHg and disposed so that the maximum suction negative pressure can be obtained. The suction ports 7B are optimized for a working negative pressure of −400 mmHg and disposed so that the maximum suction negative pressure can be obtained. By doing so, characteristics as shown in FIG. 10 can be obtained. In FIG. 10, the curve ① shows the suction negative pressure obtained from the suction ports 7A, and the curve ② shows the suction negative pressure from the suction ports 7B. Thus, in a low working negative pressure region where the working negative pressure is not higher than −350 mmHg, a high suction negative pressure can be obtained from the suction ports 7A. In a high working negative pressure region where the working negative pressure exceeds −350 mmHg, a high suction negative pressure can be obtained from the suction ports 7B. Consequently, a high suction negative pressure can be obtained over a wide working negative pressure range.

Next, a first embodiment of the negative pressure supply apparatus according to the present invention that uses an ejector having a Laval nozzle structure similar to that of the above-described ejector 1 will be described with reference to FIGS. 11 to 14.

Figure 11:
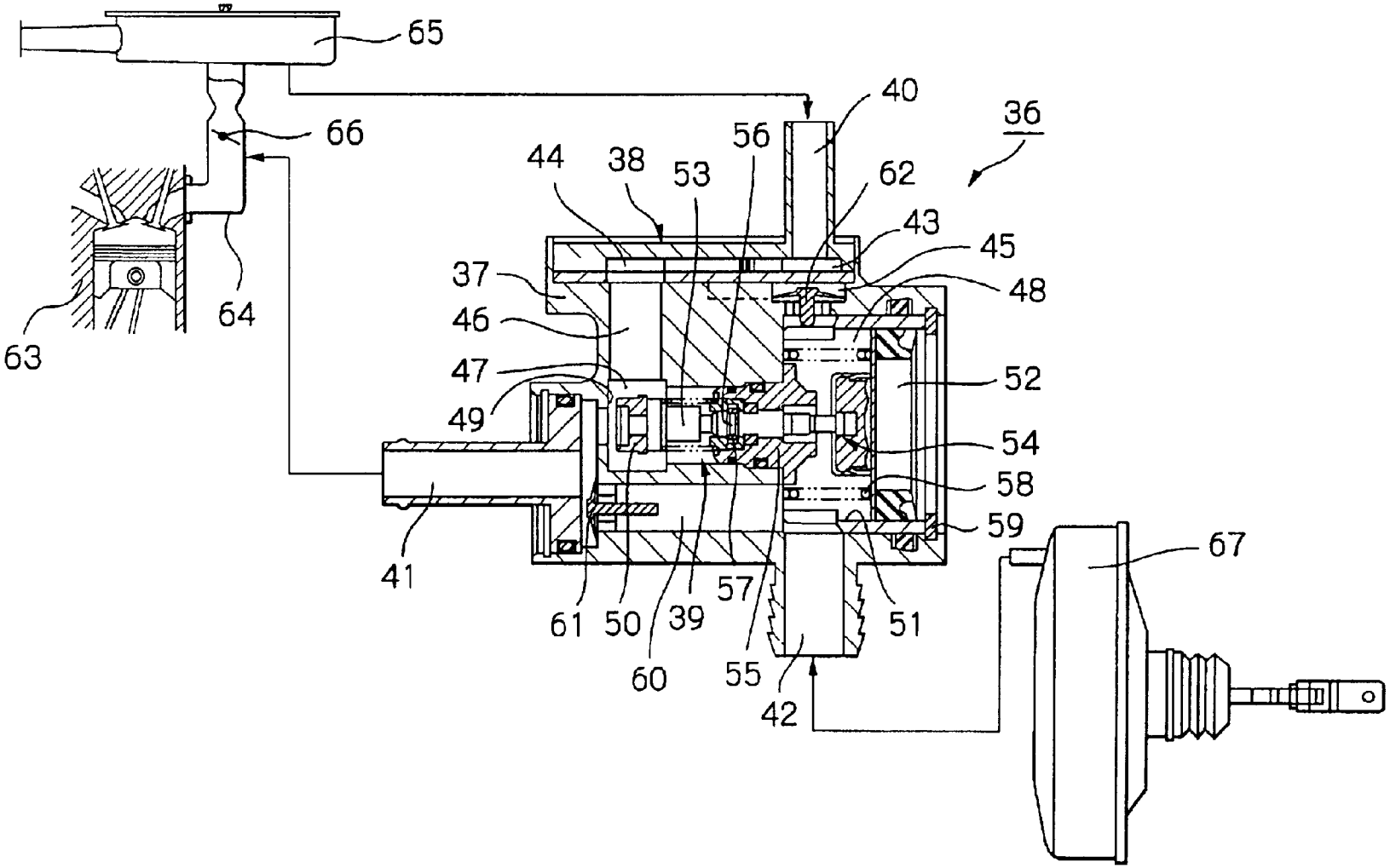
FIG. 11 is a vertical sectional view of a first embodiment of the negative pressure supply apparatus according to the present invention, showing a state where a control valve is open, and a control piston is in a retracted position.
Figure 12:
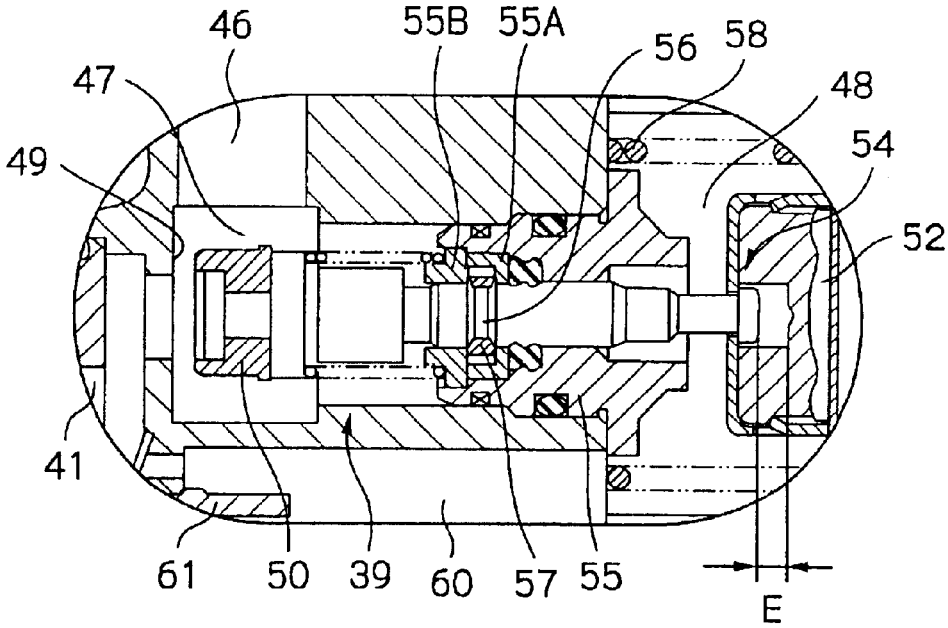
FIG. 12 is an enlarged view of an essential part of the apparatus shown in FIG. 11.

As shown in FIGS. 11 and 12, a negative pressure supply apparatus 36 has an ejector 38 and a control valve 39 in a body casing 37. The negative pressure supply apparatus 36 has an air inlet port 40, an air outlet port 41, and a negative pressure port 42.

The ejector 38 has a Laval nozzle structure similar to that of the ejector 1. When air is allowed to flow from an air inlet 43 to an air outlet 44, a high-speed jet is produced, whereby a high negative pressure can be generated at a negative pressure outlet 45. The air inlet 43 is communicated with the air inlet port 40. The air outlet 44 is communicated with the air outlet port 41 through a passage 46 and further through a valve chamber 47 of the control valve 39. The negative pressure outlet 45 is communicated with the negative pressure port 42 through a control chamber 48 (described later) of the control valve 39.

The control valve 39 has an annular valve seat 49 formed in the valve chamber 47. A cylindrical valving element 50 is provided to face the valve seat 49 so as to separate from or rest on the latter. When the valving element 50 is separate from the valve seat 49, the passage 46 and the air outlet port 41 are in communication with each other. When the valving element 50 rests on the valve seat 49, the communication between the passage 46 and the air outlet port 41 is cut off. A control piston 52 is slidably fitted in a cylinder bore 51 formed in one end portion of the body casing 37. A control chamber 48 is formed in the cylinder bore 51 at one end of the control piston 52. The other end of the control piston 52 is open to the atmosphere. The valving element 50 and the control piston 52 are connected to each other by a connecting rod 53. The joint 54 between the control piston 52 and the connecting rod 53 allows the control piston 52 and the connecting rod 53 to move relative to each other by a distance E (see FIG. 12).

The connecting rod 53 is slidably guided by a guide member 55 secured to the body casing 37. The connecting rod 53 is formed with an outer peripheral groove 56 tapered at both ends thereof. A lock ring 57 is fitted on the connecting rod 53. The lock ring 57 comprises an elastic member tapered at both ends thereof so as to fit into the outer peripheral groove 56. The elastic member has a C-shaped configuration as seen in the direction of the axis of the connecting rod 53. The lock ring 57 is locked from moving in the axial direction by the guide member 55, a retainer 55A and a spring retainer 55B. When the valving element 50 is at a predetermined valve-opening position where it is separate from the valve seat 49, the lock ring 57 fits into the outer peripheral groove 56 to hold the connecting rod 53 from moving axially by the elastic force of the lock ring 57. When a predetermined force acts on the lock ring 57 in the axial direction, the lock ring 57 is expanded to allow the connecting rod 53 to move. The lock ring 57 may be a C-ring made, for example, of a synthetic resin or metallic material having elasticity. Alternatively, the lock ring 57 may be an O-ring made, for example, of a rubber or synthetic resin material. The control piston 52 is biased toward the atmosphere side by a control spring 58 provided in the control chamber 48. The control piston 52 abuts against a stopper 59 at a position where it is most retracted.

The body casing 37 is provided with a passage 60 for communication between the air outlet port 41 and the negative pressure port 42. A check valve 61 (first check valve) is provided in the passage 60 to allow air to flow only in the direction from the negative pressure port 42 to the air outlet port 41. A check valve 62 (second check valve) is provided between the negative pressure outlet 45 of the ejector 38 and the control chamber 48 to allow air to flow only in the direction from the control chamber 48 to the negative pressure outlet 45.

The air inlet port 40 of the negative pressure supply apparatus 36 is open to the atmosphere through an air cleaner 65 provided in the upstream part of an intake pipe 64 of an engine 63 serving as a negative pressure source. The air outlet port 41 is connected to the downstream side of a throttle valve 66 in the intake pipe 64. The negative pressure port 42 is connected to a negative pressure chamber of a pneumatic booster 67.

The operation of the embodiment arranged as stated above will be described below.

The negative pressure in the intake pipe 64 of the engine 63 is introduced into the negative pressure chamber of the pneumatic booster 67 through the air outlet port 41, the check valve 61, the passage 60 and the negative pressure port 42 of the negative pressure supply apparatus 36. When the negative pressure in the negative pressure chamber of the pneumatic booster 67 is low, for example, immediately after the engine 63 has started, the control piston 52 is kept in the retracted position by the control spring 58. Accordingly, the valving element 50 is separate from the valve seat 49, and thus the air outlet port 41 and the passage 46 are in communication with each other (see FIGS. 11 and 12). Under these conditions, the negative pressure in the intake pipe 64 of the engine 63 causes air to flow from the air inlet 43 to the air outlet 44 of the ejector 38 through the air outlet port 41 and the passage 46. As a result, a negative pressure is generated at the negative pressure outlet 45. The negative pressure is introduced into the negative pressure chamber of the pneumatic booster 67 through the check valve 62, the control chamber 48 and the negative pressure port 42. Thus, even when the negative pressure in the intake pipe 64 is low, for example, immediately after the engine 63 has started, a high negative pressure is generated at the negative pressure outlet 45 by the effect of the ejector 38. Accordingly, it is possible to supply a high negative pressure to the negative pressure chamber of the pneumatic booster 67 and hence possible to solve the shortage of servo power.

Figure 13:
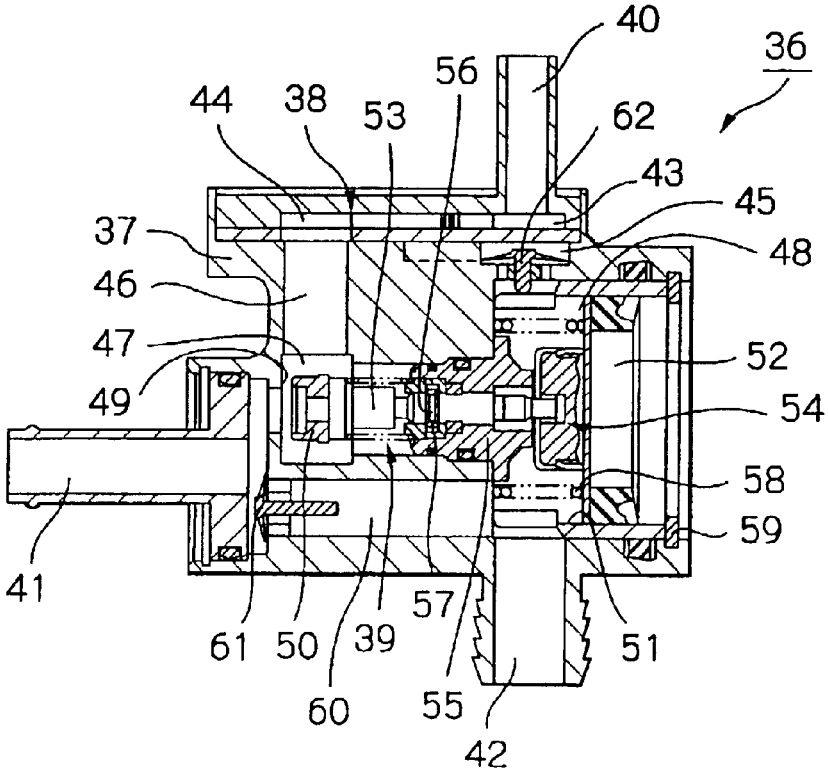
FIG. 13 is a vertical sectional view of the apparatus in FIG. 11, showing a state where the control valve is open, and the control piston is in an advanced position.

As the negative pressure in the negative pressure chamber of the pneumatic booster 67 increases, the negative pressure in the control chamber 48 communicating with the negative pressure chamber increases. The differential pressure between the negative pressure and the atmospheric pressure causes the control piston 52 to move against the biasing force of the spring 58. At the early stages of the movement of the control piston 52, because the connecting rod 53 is locked by the lock ring 57, the control piston 52 and the connecting rod 53 move relative to each other, and the valving element 50 is held in the valve-opening position, as shown in FIG. 13.

As the negative pressure in the control chamber 48 further increases, the control piston 52 and the connecting rod 53 further move relative to each other until the distance E (see FIG. 12) is canceled. When force applied to the connecting rod 53 by the atmospheric pressure exceeds the holding force of the lock ring 57 after the distance E has been canceled, the lock ring 57 is expanded to allow the connecting rod 53 to move, causing the valving element 50 to rest on the valve seat 49, thereby cutting off the communication between the air outlet port 41 and the passage 46.

As a result, the operation of the ejector 38 stops. Consequently, the negative pressure in the intake pipe 64 is introduced directly into the pneumatic booster 67. In this way, when the negative pressure in the negative pressure chamber of the pneumatic booster 67 is sufficiently high, the operation of the ejector 38 is stopped, whereby the flow of intake air bypassing the throttle valve 66 through the ejector 38 can be cut off, and thus the effect on the air-fuel ratio can be minimized. At this time, the valving element 50 rests on the valve seat 49 rapidly when the force applied to the control piston 52 by the atmospheric pressure has exceeded the holding force of the lock ring 57. Therefore, the function of the ejector 38 will not be degraded during the period of valve-closing transition by restriction of the flow path between the passage 46 and the air outlet port 41 by the valving element 50.

Figure 14:
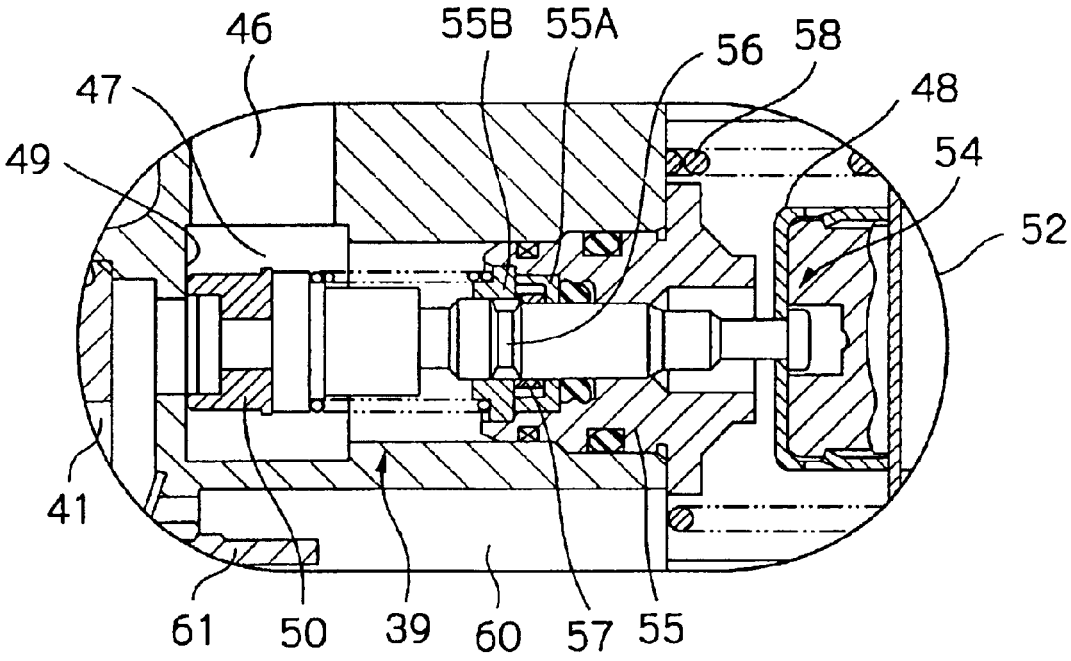
FIG. 14 is a vertical sectional view of the apparatus in FIG. 11, showing a state where the control valve is closed, and the control piston is in a retracted position.

As the brake system operates, the negative pressure in the negative pressure chamber of the pneumatic booster 67 reduces, and hence the negative pressure in the control chamber 48 reduces. Consequently, the control piston 52 is retracted by the control spring 58. At this time, the valving element 50 is subjected to the negative pressure in the intake pipe 64, and the connecting rod 53 is subjected to clamping force or frictional force from the lock ring 57 which is now placed out of the outer peripheral groove 56. Accordingly, only the control piston 52 retracts by the distance E (see FIG. 12) first, as shown in FIG. 14. The valving element 50 is kept in the valve-closing position.

When the spring force of the control spring 58 has exceeded the negative pressure acting on the valving element 50 and the holding force of the lock ring 57 as a result of further reduction of the negative pressure in the negative pressure chamber of the pneumatic booster 67, the connecting rod 53 retracts, together with the control piston 52. Consequently, the valving element 50 separates from the valve seat 49 to open the valve. At this time, when the valving element 50 separates from the valve seat 49, the negative pressure acting on the valving element 50 reduces rapidly. Therefore, the valving element 50 can be separated from the valve seat 49 rapidly to open the valve. Accordingly, the function of the ejector 38 will not be degraded during the period of valve-opening transition by restriction of the flow path between the passage 46 and the air outlet port 41 by the valving element 50.

Thus, the pressure in the control chamber 48 during the valve-opening operation of the valving element 50 has a hysteresis with respect to the pressure during the valve-closing operation. Thus, once the valving element 50 has rested on the valve seat 49 to close the valve as a result of the negative pressure in the negative pressure chamber of the pneumatic booster 67 being increased to a predetermined negative pressure, the valving element 50 cannot separate from the valve seat 49 until the negative pressure has reduced to a certain extent. Therefore, it is possible to minimize the effect on the air-fuel ratio in the engine. In general, once the negative pressure in the negative pressure chamber of the pneumatic booster 67 has reached a predetermined negative pressure, it can be maintained by the negative pressure in the intake pipe 64 without using the ejector 38.

In addition, the surface of the valving element 50 closer to the air outlet port 41 is subjected to the negative pressure in the intake pipe 64 of the engine 63, whereas the surface of the valving element 50 closer to the valve chamber 47 is subjected to the atmospheric pressure. Therefore, the differential pressure between them assists the valving element 50 in moving in the valve-closing direction and allows the valving element 50 as rested on the valve seat 49 to be kept in the valve-closing position favorably.

Next, a second embodiment of the negative pressure supply apparatus according to the present invention that uses an ejector having a Laval nozzle structure similar to that of the above-described ejector 1 will be described with reference to FIGS. 15 to 20.

Figure 15:
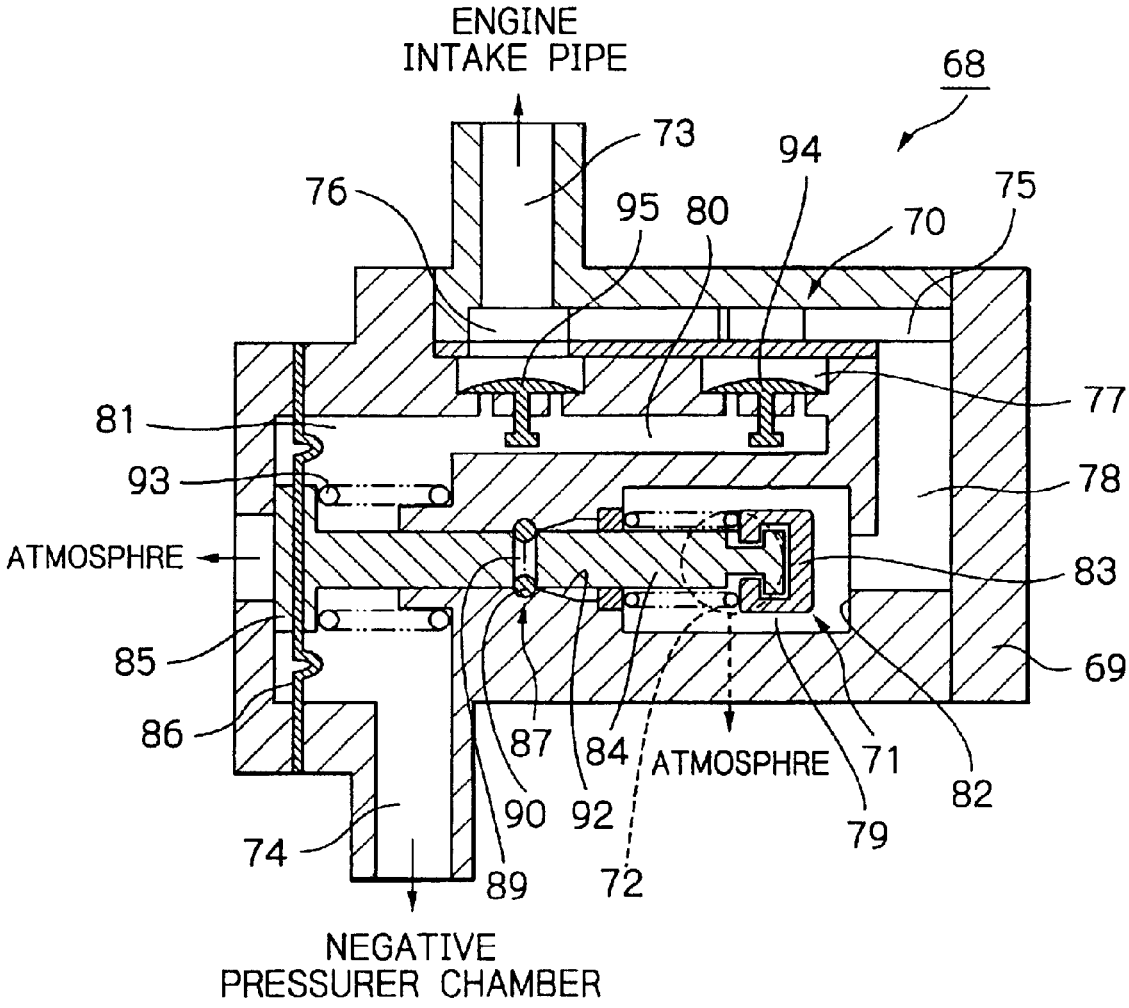
FIG. 15 is a vertical sectional view of a second embodiment of the negative pressure supply apparatus according to the present invention, showing a state where a control valve is open.

As shown in FIG. 15, a negative pressure supply apparatus 68 has an ejector 70 and a control valve 71 in a body casing 69. The negative pressure supply apparatus 68 has an air inlet port 72, an air outlet port 73, and a negative pressure port 74.

The ejector 70 has a Laval nozzle structure similar to that of the ejector 1. When air is allowed to flow from an air inlet 75 to an air outlet 76, a high-speed jet is produced, whereby a high negative pressure can be generated at a negative pressure outlet 77. The air inlet 75 is communicated with the air inlet port 72 through a passage 78 and further through a valve chamber 79 of the control valve 71. The air outlet 76 is communicated with the air outlet port 73. The negative pressure outlet 77 is communicated with the negative pressure port 74 through a passage 80 and further through a control chamber 81 (described later) of the control valve 71.

The control valve 71 has a valve seat 82 formed in the valve chamber 79. A valving element 83 is provided to face the valve seat 82 so as to separate from or rest on the latter. When the valving element 83 is separate from the valve seat 82, the passage 78 and the air inlet port 72 are in communication with each other. When the valving element 83 rests on the valve seat 82, the communication between the passage 78 and the air inlet port 72 is cut off. The valving element 83 is installed on one end of a connecting rod 84 slidably guided by the body casing 69. The other end portion of the connecting rod 84 is inserted into a control chamber 81 and connected to a control piston 85. The control piston 85 has a diaphragm 86 to form the control chamber 81 at one end thereof. The other end of the control piston 85 is open to the atmosphere.

Figure 16:
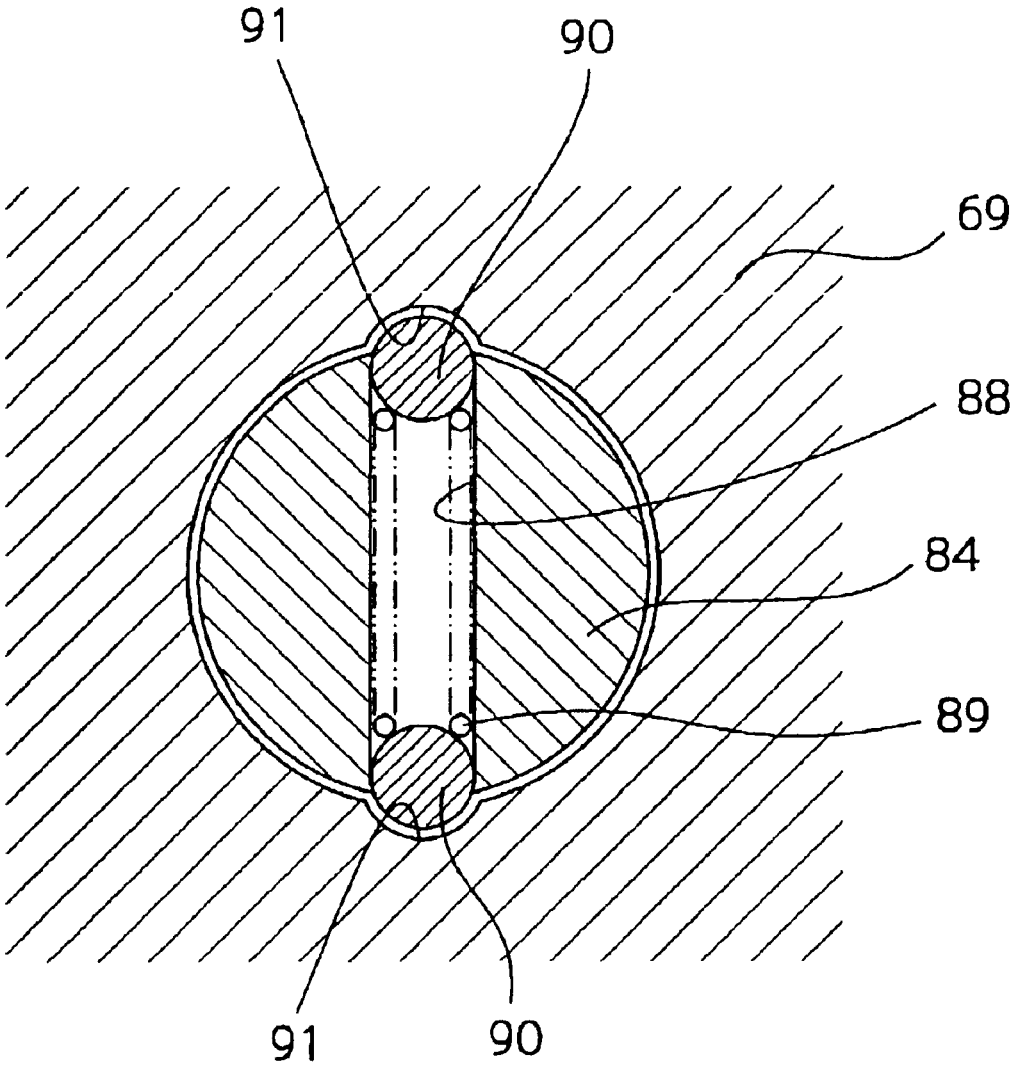
FIG. 16 is a vertical sectional view of a lock mechanism used in the apparatus shown in FIG. 15.

The connecting rod 84 is provided with a lock mechanism 87. The lock mechanism 87 is arranged as shown in FIG. 16. Two balls 90 are inserted in a ball hole 88 diametrically provided in the connecting rod 84, with a compression spring 89 interposed between the balls 90. The balls 90 are engaged in hemispherical recesses 91 (or an annular groove) formed in a part of the body casing 69, thereby holding the connecting rod 84 from moving in the axial direction.

Figure 17:
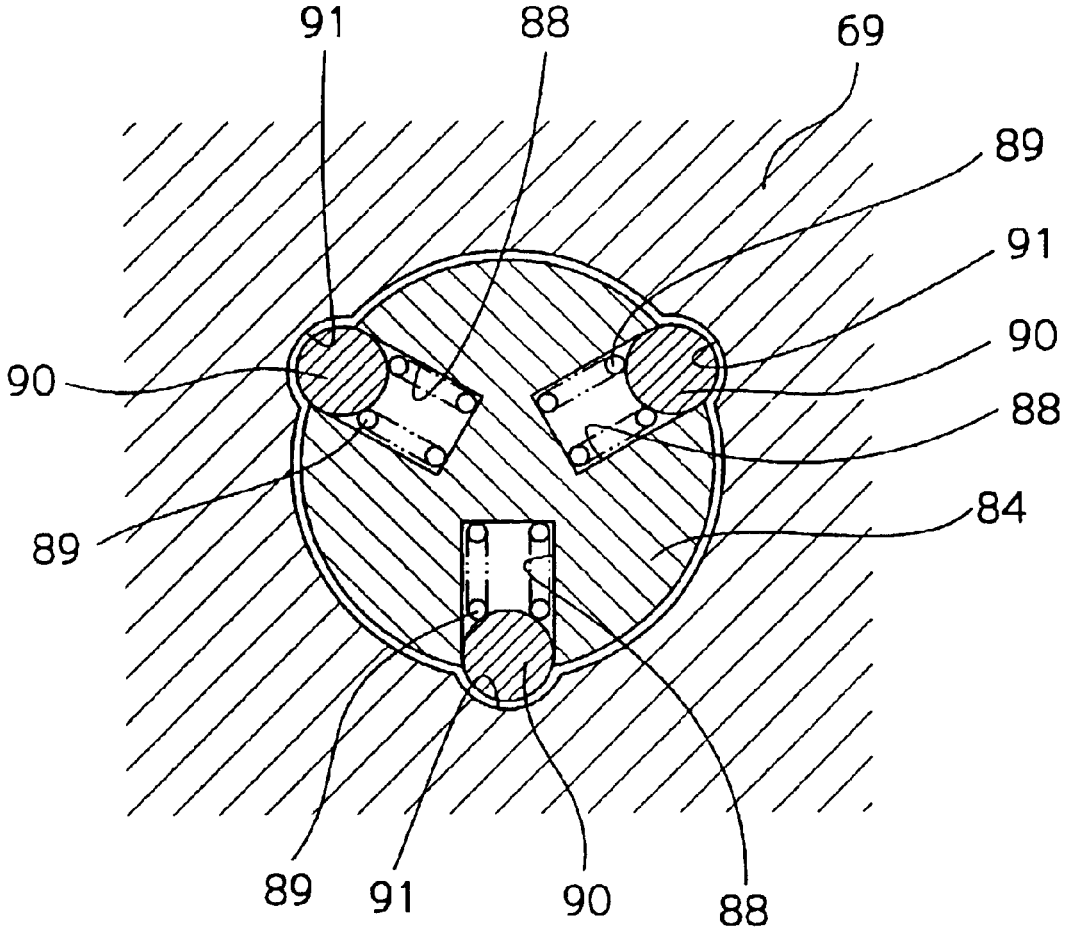
FIG. 17 is a vertical sectional view of another example of the lock mechanism used in the apparatus shown in FIG. 15.
Figure 18:
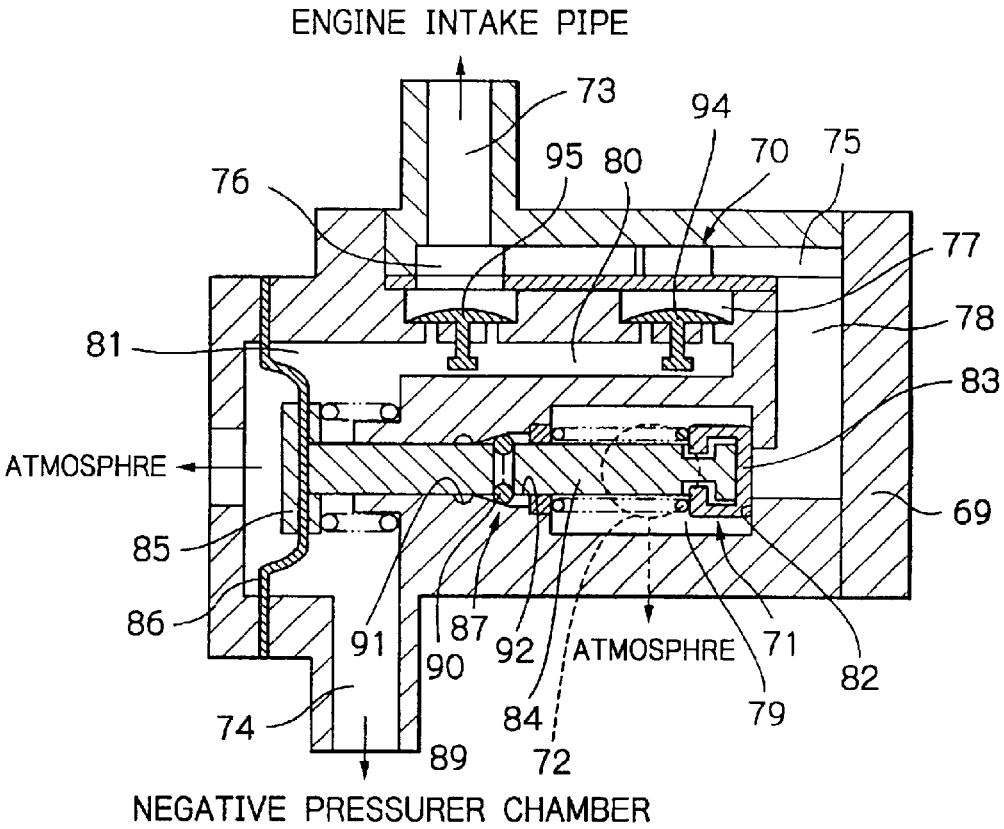
FIG. 18 is a vertical sectional view of the apparatus in FIG. 15, showing a state where the control valve is closed.

It should be noted that the lock mechanism 87 may be arranged as shown in FIG. 17. That is, the connecting rod 84 is provided with a plurality (three in the illustrated example) of circumferentially spaced radial ball holes 88. Balls 90 are inserted into the ball holes 88, respectively, with a compression spring 89 interposed between each ball 90 and the bottom of the associated ball hole 88. The balls 90 are engaged in hemispherical recesses 91 formed in a part of the body casing 69, thereby holding the connecting rod 84 from moving in the axial direction.

The body casing 69 has a tapered portion 92 (see FIG. 15) formed adjacent to the recesses 91 for engagement with the balls 90. The tapered portion 92 increases in diameter toward the valve seat 82. The control piston 85 is biased toward the atmosphere side by a control spring 93 provided in the control chamber 81. Normally, the connecting rod 84 is in a retracted position, i.e. a valve-opening position, shown in FIG. 15, and held from moving in the axial direction by engagement of the balls 90 in the recesses 91. In this state, the valving element 83 is separate from the valve seat 82 to open the valve.

The body casing 69 is provided with a check valve 94 (second check valve) for allowing air to flow only in the direction from the passage 80 to the negative pressure outlet 77 of the ejector 70 and further provided with a check valve 95 (first check valve) for allowing air to flow only in the direction from the passage 80 to the air outlet 76 of the ejector 70. The air inlet port 72 of the negative pressure supply apparatus 68 is open to the atmosphere through an air cleaner (not shown). The air outlet port 73 is connected to an engine intake pipe. The negative pressure port 74 is connected to a negative pressure chamber of a pneumatic booster.

The operation of the embodiment arranged as stated above will be described below.

The negative pressure in the engine intake pipe is introduced into the negative pressure chamber of the pneumatic booster through the air outlet port 73, the check valve 95, the passage 80, the control chamber 81 and the negative pressure port 74 of the negative pressure supply apparatus 68. When the negative pressure in the negative pressure chamber of the pneumatic booster is low, for example, immediately after the engine has started, the control piston 85 is kept in the retracted position by the control spring 93. Accordingly, the valving element 83 is separate from the valve seat 82, and thus the air inlet port 72 and the passage 78 are in communication with each other (see FIG. 15). Under these conditions, the negative pressure in the engine intake pipe causes air to flow from the air inlet 75 to the air outlet 76 of the ejector 70 through the air outlet port 73, the passage 78, the valve chamber 79 and the air inlet port 72. Consequently, a negative pressure is generated at the negative pressure outlet 77. The negative pressure is introduced into the negative pressure chamber of the pneumatic booster through the check valve 94, the passage 80, the control chamber 81 and the negative pressure port 74. Thus, even when the negative pressure in the intake pipe is low, for example, immediately after the engine has started, a high negative pressure is generated at the negative pressure outlet 77 by the effect of the ejector 70. Accordingly, it is possible to supply a high negative pressure to the negative pressure chamber of the pneumatic booster and hence possible to solve the shortage of servo power.

As the negative pressure in the negative pressure chamber of the pneumatic booster increases, the negative pressure in the control chamber 81 communicating with the negative pressure chamber increases. Force due to the differential pressure between the negative pressure and the atmospheric pressure acts on the connecting rod 84. At this time, the connecting rod 84 is held by the lock mechanism 87. Therefore, the connecting rod 84 cannot move until the force due to the negative pressure in the control chamber 81 (i.e. the differential pressure between the negative pressure and the atmospheric pressure) exceeds the holding force of the lock mechanism 87. When the force due to the negative pressure in the control chamber 81 has exceeded the holding force of the lock mechanism 87, the spring 89 of the lock mechanism 87 is compressed, causing the balls 90 to be retracted. As a result, the engagement between the balls 90 and the recesses 91 is canceled, thereby allowing the connecting rod 84 to move. As the connecting rod 84 moves, the balls 90 are pressed against the slant surface of the tapered portion 92 by the spring 89 to promote the movement of the connecting rod 84. Accordingly, the valving element 83 rests on the valve seat 82 rapidly to cut off the communication between the air inlet port 72 and the passage 78 (see FIG. 18).

Consequently, the operation of the ejector 70 stops, and the negative pressure in the intake pipe is introduced directly into the pneumatic booster. Thus, when the negative pressure in the negative pressure chamber of the pneumatic booster is sufficiently high, the operation of the ejector 70 is stopped, whereby the flow of intake air bypassing the throttle valve through the ejector 70 can be cut off, and thus the effect on the air-fuel ratio can be minimized. The valving element 83 rests on the valve seat 82 rapidly when the negative pressure in the control chamber 81 acting on the control piston 85 exceeds the holding force of the lock mechanism 87. Therefore, the function of the ejector 70 will not be degraded during the period of valve-closing transition by restriction of the flow path between the air inlet port 72 and the passage 78 by the valving element 83.

As the brake system operates, the negative pressure in the negative pressure chamber of the pneumatic booster reduces, and hence the negative pressure in the control chamber 81 reduces. Consequently, the control piston 85 is retracted by the spring force of the control spring 93. At this time, the negative pressure in the passage 78 acts on the valving element 83 to keep it in the valve-closing position. Accordingly, the valving element 83 cannot separate from the valve seat 82 to open the valve until the negative pressure in the control chamber 81 reduces sufficiently. After the valve has opened, the action of the negative pressure in the passage 78 is canceled rapidly. Accordingly, the pressure during the valve-opening operation of the valving element 83 has a hysteresis with respect to the pressure during the valve-closing operation. Thus, once the valving element 83 has rested on the valve seat 82 to close the valve as a result of the negative pressure in the negative pressure chamber of the pneumatic booster being increased to a predetermined negative pressure, the valving element 83 cannot separate from the valve seat 82 until the negative pressure has reduced to a certain extent. Therefore, it is possible to minimize the effect on the air-fuel ratio in the engine. In general, once the negative pressure in the negative pressure chamber of the pneumatic booster has reached a predetermined negative pressure, it can be maintained by the negative pressure in the intake pipe without using the ejector 70.

Figure 19:
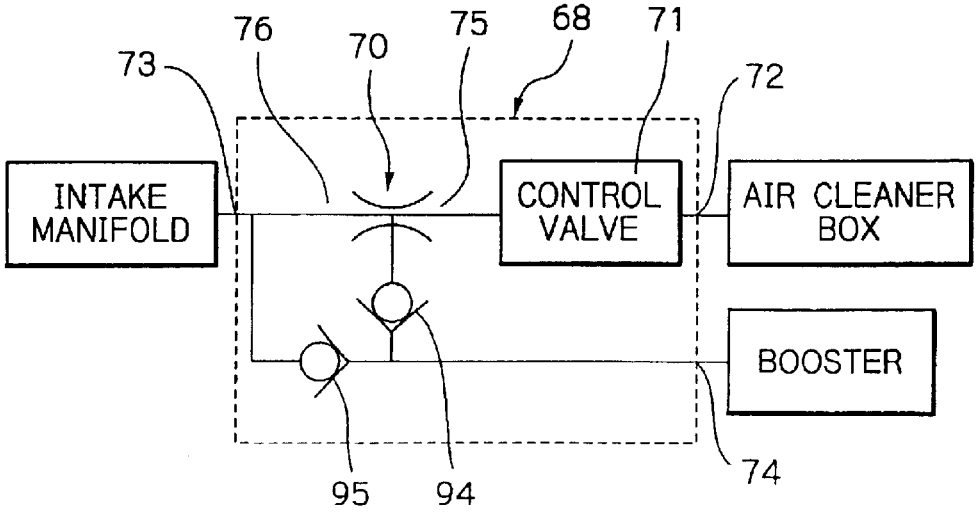
FIG. 19 is a block diagram schematically showing the arrangement of the apparatus shown in FIG. 15.
Figure 20:
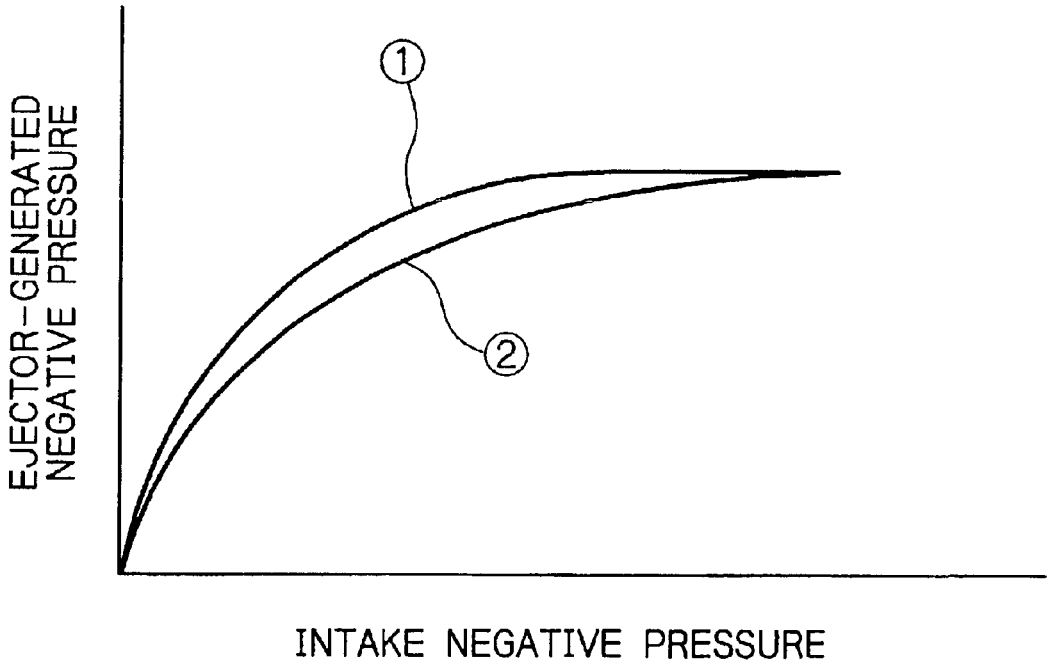
FIG. 20 is a diagram showing the relationship between the intake negative pressure and the ejector-generated negative pressure in the apparatus shown in FIG. 15.

In this embodiment, as shown in FIG. 19, the control valve 71 is disposed between the air inlet 75 of the ejector 70 and the air inlet port 72, i.e. upstream of the air inlet 75. Therefore, the pressure loss caused by the control valve 71 can be reduced more than in an arrangement wherein the control valve 71 is disposed downstream of the air outlet 76 of the ejector 70. Accordingly, it is possible to increase the efficiency of the ejector 70 and hence possible to obtain a high negative pressure. FIG. 20 shows the relationship between the intake negative pressure and the ejector-generated negative pressure in regard to two arrangements: one in which the control valve is disposed upstream of the air inlet of the ejector (this embodiment; see the curve ①); and another in which the control valve is disposed downstream of the air outlet (see the curve ②).

The surface of the valving element 83 closer to the passage 78 is subjected to the negative pressure in the engine intake pipe, whereas the surface of the valving element 83 closer to the valve chamber 79 is subjected to the atmospheric pressure. Therefore, the differential pressure between them assists the valving element 83 in moving in the valve-closing direction and allows the valving element 83 as rested on the valve seat 82 to be kept in the valve-closing position favorably.

As has been detailed above, the ejector according to the present invention uses a Laval nozzle to allow the flow velocity at the throat portion to reach the velocity of sound even when the intake negative pressure is low, and hence can obtain a high negative pressure. Further, the inlet of the diffuser is enlarged and extended approximately parallel to the axis of the diffuser, whereby the suction air quantity can be increased without reducing the ultimate vacuum. Consequently, a high negative pressure can be obtained with a low intake negative pressure. Moreover, a sufficiently large suction air quantity can be obtained. Accordingly, a stable negative pressure can be supplied.

According to the negative pressure supply apparatus of the present invention, the control valve is open until the negative pressure at the negative pressure port reaches a predetermined negative pressure. The ejector is operated by the negative pressure from the negative pressure source to supply a negative pressure to the negative pressure port from the negative pressure outlet through the second check valve. When the negative pressure at the negative pressure port has reached the predetermined negative pressure, the control valve is closed to stop the operation of the ejector. Consequently, the negative pressure from the negative pressure source is supplied directly to the negative pressure port through the first check valve. Because the control valve is closed rapidly, the function of the ejector will not be degraded during the period of valve-closing transition by restriction of the flow path by the control valve. Consequently, the effect on the air-fuel ratio in the engine can be minimized, and a stable negative pressure can be supplied.

Further, the negative pressure supply apparatus according to the present invention minimizes the pressure loss caused by the control valve. Therefore, the efficiency of the ejector can be increased, and a stable negative pressure can be supplied.

According to the negative pressure supply apparatus of the present invention, the differential pressure acting on the valving element assists the valving element in moving in the valve-closing direction and allows the valving element as rested on the valve seat to be kept in the valve-closing position favorably.

It should be noted that the present invention is not necessarily limited to the foregoing embodiments but can be modified in a variety of ways without departing from the gist of the present invention.

What is claimed is:

1. A negative pressure supply apparatus comprising:

an air outlet port connected to a negative pressure source;

an air inlet port open to the atmosphere;

a negative pressure port connected to a negative pressure chamber of a negative pressure device;

a passage for providing communication between said air outlet port and said negative pressure port;

a first check valve for allowing air to flow through said passage only in a direction from said negative pressure port to said air outlet port;

an ejector having an air outlet communicating with said air outlet port, an air inlet communicating with said air inlet port, and a negative pressure outlet communicating with said negative pressure port;

a second check valve for allowing air to flow only in a direction from said negative pressure port to said negative pressure outlet; and a control valve for selectively opening or closing either the air outlet or the air inlet of said ejector;

wherein said control valve operates in response to a negative pressure at said negative pressure port such that said control valve is open until the negative pressure reaches a predetermined negative pressure, and when said negative pressure has reached the predetermined negative pressure, said control valve is closed rapidly.

2. A negative pressure supply apparatus according to claim 1, further comprising:

a mechanism for restraining movement of said control valve to keep a valve-open state until the negative pressure at said negative pressure port reaches a predetermined pressure, said mechanism releasing said control valve from restraint when the negative pressure at said negative pressure port has reached the predetermined pressure, thereby allowing said control valve to be closed rapidly.

3. A negative pressure supply apparatus according to claim 1, wherein said control valve is disposed on the side of said air inlet with respect to said ejector.

4. A negative pressure supply apparatus according to claim 1, wherein said control valve has a valving member being movable in a valve-closing direction in response to a differential pressure.

5. A negative pressure supply apparatus according to claim 2, wherein said control valve is disposed on the side of said air inlet with respect to said ejector.

6. An ejector comprising:

a nozzle having a rectangular cross section including an inlet portion having converging opposite side walls, an outlet portion having diverging opposite side walls, and a throat portion between the inlet and outlet portions;

a diffuser, having a rectangular cross section, disposed downstream of said nozzle; and a suction port disposed between said nozzle and said diffuser, wherein said nozzle and said diffuser form a substantially single Laval nozzle, said diffuser includes an inlet having opposite parallel side walls extending from an opening of said suction port so that the opposite side walls of the diffuser inlet come outside the imaginary extension lines of said opposite side walls of said nozzle outlet portion, and the portion of said diffuser downstream of said inlet has diverging opposite side walls.

7. An ejector according to claim 6, wherein said opposite diverging side walls of the diffuser are generally aligned with said imaginary lines extending from said opposite side walls of said nozzle outlet portion.

8. An ejector according to claim 6, wherein the parallel portions of said side walls of said inlet have a length set longer than the width of said inlet.

9. An ejector according to claim 6, further comprising:

an ejector body;

a back plate; and a seal plate disposed between said ejector body and said back plate;

wherein said nozzle, said diffuser, and said suction port are formed in said ejector body.

10. An ejector comprising:

a nozzle having a circular cross section and including an inlet portion having a converging wall, an outlet portion having a diverging wall, and a throat portion between the inlet and outlet portions;

a diffuser, having a circular cross section, disposed downstream of said nozzle; and a suction port disposed between said nozzle and said diffuser, wherein said nozzle and said diffuser form a substantially single Laval nozzle, said diffuser includes an inlet defined by a straight tubular wall extending from an opening of said suction port so that the wall of said diffuser inlet comes outside the imaginary extension surface of said wall of said nozzle outlet portion, and the portion of said diffuser downstream of said inlet has a diverging wall.

11. An ejector according to claim 10, wherein said diverging wall of the diffuser is generally aligned with said imaginary surface extending from said wall of said nozzle outlet portion.

12. An ejector according to claim 10, wherein the parallel portions of said side walls of said inlet have a length set longer than the width of said inlet.

13. An ejector according to claim 10, comprising:

an ejector body;

a back plate; and a seal plate disposed between said ejector body and said back plate;

wherein said nozzle, said diffuser, and said suction port are formed in said ejector body.

14. A negative pressure supply apparatus comprising:

an air outlet port connected to a negative pressure source;

an air inlet port open to the atmosphere;

a negative pressure port connected to a negative pressure chamber of a negative pressure device;

a passage for providing communication between said air outlet port and said negative pressure port;

a first check valve for allowing air to flow through said passage only in a direction from said negative pressure port to said air outlet port;

an ejector having an air outlet communicating with said air outlet port, an air inlet communicating with said air inlet port, and a negative pressure outlet communicating with said negative pressure port;

a second check valve for allowing air to flow only in a direction from said negative pressure port to said negative pressure outlet; and a control valve for selectively opening or closing either the air outlet or the air inlet of said ejector, wherein said control valve operates in response to a negative pressure at said negative pressure port such that said control valve is open until the negative pressure reaches a predetermined negative pressure, and when said negative pressure has reached the predetermined negative pressure, said control valve is closed, wherein said ejector comprises:

a nozzle having a rectangular cross section including an inlet portion having converging opposite side walls, an outlet portion having diverging opposite side walls, and a throat portion between the inlet and outlet portions;

a diffuser having a rectangularcross section and being disposed downstream of said nozzle; and a suction port disposed between said nozzle and said diffuser, and wherein said nozzle and said diffuser form a substantially single Laval nozzle, said diffuser includes an inlet having opposite parallel side walls extending from an opening of said suction port so that the opposite side walls of the diffuser inlet come outside the imaginary extension lines of said opposite side walls of said nozzle outlet portion, and the portion of said diffuser downstream of said inlet has diverging opposite side walls.

15. A negative pressure supply apparatus according to claim 14, wherein said opposite diverging side walls of said diffuser are generally aligned with the imaginary lines extending from said opposite side walls of said nozzle outlet portion.

16. A negative pressure supply apparatus according to claim 14, wherein said control valve is disposed on the side of said air inlet with respect to said ejector.

17. A negative pressure supply apparatus according to claim 14, wherein said control valve has a valving member being movable in a valve-closing direction in response to a differential pressure.

18. A negative pressure supply apparatus comprising:

an air outlet port connected to a negative pressure source;

an air inlet port open to the atmosphere;

a negative pressure port connected to a negative pressure chamber of a negative pressure device;

a passage for providing communication between said air outlet port and said negative pressure port;

a first check valve for allowing air to flow through said passage only in a direction from said negative pressure port to said air outlet port;

an ejector having an air outlet communicating with said air outlet port, an air inlet communicating with said air inlet port, and a negative pressure outlet communicating with said negative pressure port;

a second check valve for allowing air to flow only in a direction from said negative pressure port to said negative pressure outlet; and a control valve for selectively opening or closing either the air outlet or the air inlet of said ejector, wherein said control valve operates in response to a negative pressure at said negative pressure port such that said control valve is open until the negative pressure reaches a predetermined negative pressure, and when said negative pressure has reached the predetermined negative pressure, said control valve is closed, wherein said ejector comprises:

a nozzle having a circular cross section and including an inlet portion having a converging wall, an outlet portion having a diverging wall, and a throat portion between the inlet and outlet portions;

a diffuser having a circular cross section and being disposed downstream of said nozzle; and a suction port disposed between said nozzle and said diffuser, and wherein said nozzle and said diffuser form a substantially single Laval nozzle, said diffuser includes an inlet defined by a straight tubular wall extending from an opening of said suction port so that the wall of the diffuser inlet comes outside the imaginary extension surface of said wall of said nozzle outlet portion, and wherein the portion of said diffuser downstream of said inlet has a diverging wall.

19. A negative pressure supply apparatus according to claim 18, wherein said diverging wall of the diffuser is generally aligned with said imaginary surface extending from said wall of said nozzle outlet portion.

20. A negative pressure supply apparatus according to claim 18, wherein said control valve is disposed on the side of said air inlet with respect to said ejector.

21. A negative pressure supply apparatus according to claim 18, wherein said control valve has a valving member being movable in a valve-closing direction in response to a differential pressure.

* * * * *